United States Patent [19]

Lapp et al.

[11] 4,410,181

[45] Oct. 18, 1983

[54] ELECTRONIC BOARD GAME

[75] Inventors: Douglas E. Lapp, Lawndale; Luan G. Tran, Redondo Beach, both of Calif.

[73] Assignee: Mattel, Inc., Hawthorne, Calif.

[21] Appl. No.: 268,451

[22] Filed: May 29, 1981

[51] Int. Cl.[3] ..... A63F 3/00

[52] U.S. Cl. ..... 273/238; 273/1 E

[58] Field of Search ..... 273/1 E, 138 A, 153 R, 273/237, 238, 256, 278, DIG. 28; 364/410

[56] References Cited

U.S. PATENT DOCUMENTS

| | | | |
|---|---|---|---|
| 3,081,088 | 3/1963 | Kast | 273/153 R |
| 3,545,762 | 12/1970 | Atkinson | 273/257 |
| 3,807,739 | 4/1974 | Henley et al. | 273/256 |
| 3,865,380 | 2/1975 | Thomas | 273/256 |
| 4,103,895 | 8/1978 | Pressman et al. | 273/153 R |
| 4,223,893 | 9/1980 | Shane et al. | 273/237 |
| 4,240,638 | 12/1980 | Morrison et al. | 273/153 R |
| 4,326,719 | 4/1982 | Tran et al. | 273/238 |

*Primary Examiner*—Vance Y. Hum

*Attorney, Agent, or Firm*—Ronald M. Goldman; Max E. Shirk; Roy A. Ekstrand

[57] ABSTRACT

An electronic board game includes a playing board having a surface upon which a matrix of squares are defined. The board squares are divided into three categories. One category of squares include several groups of six contiguous squares each with each group having a group color. The second category comprises single squares spaced apart and of different colors. The remaining squares define the third category. A handheld controller includes a microprocessor which is programmed to impose a set of game rules. Player tokens are used by each player to mark each player's position on the board. Under microprocessor control and prompting, the actions and conduct of the game are carried forward.

7 Claims, 11 Drawing Figures

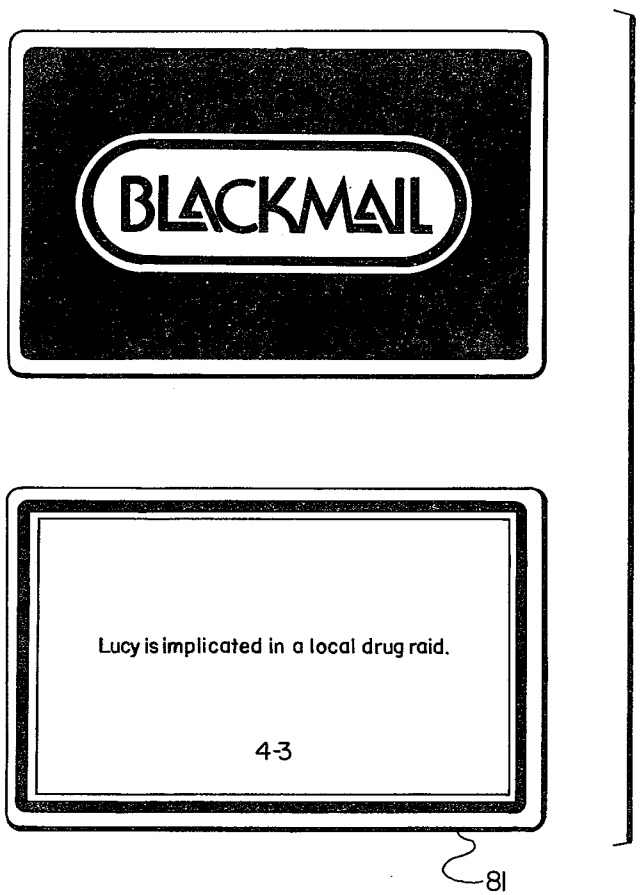
Fig. 1.B.
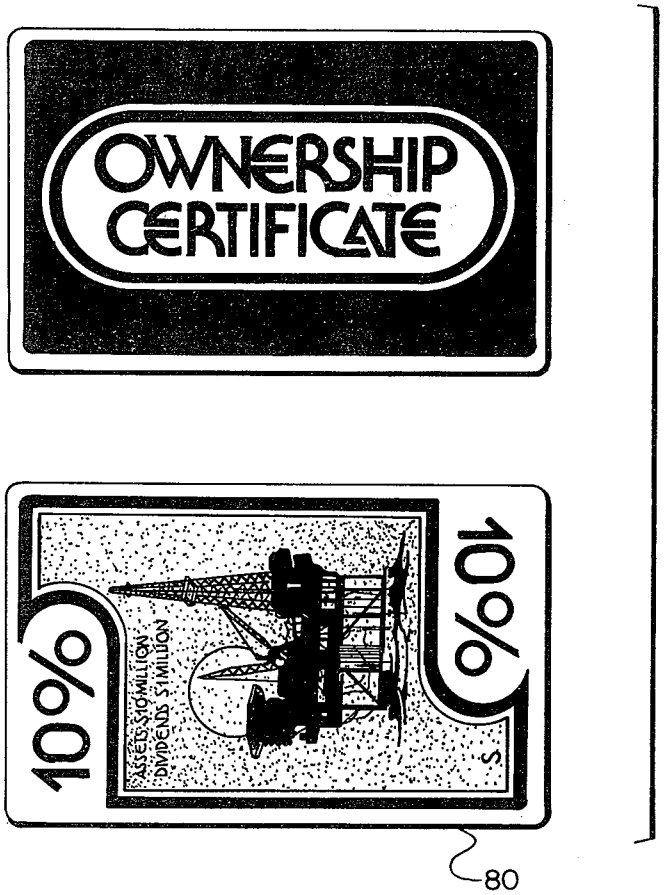
Fig. 1.A.

Fig,4,A,
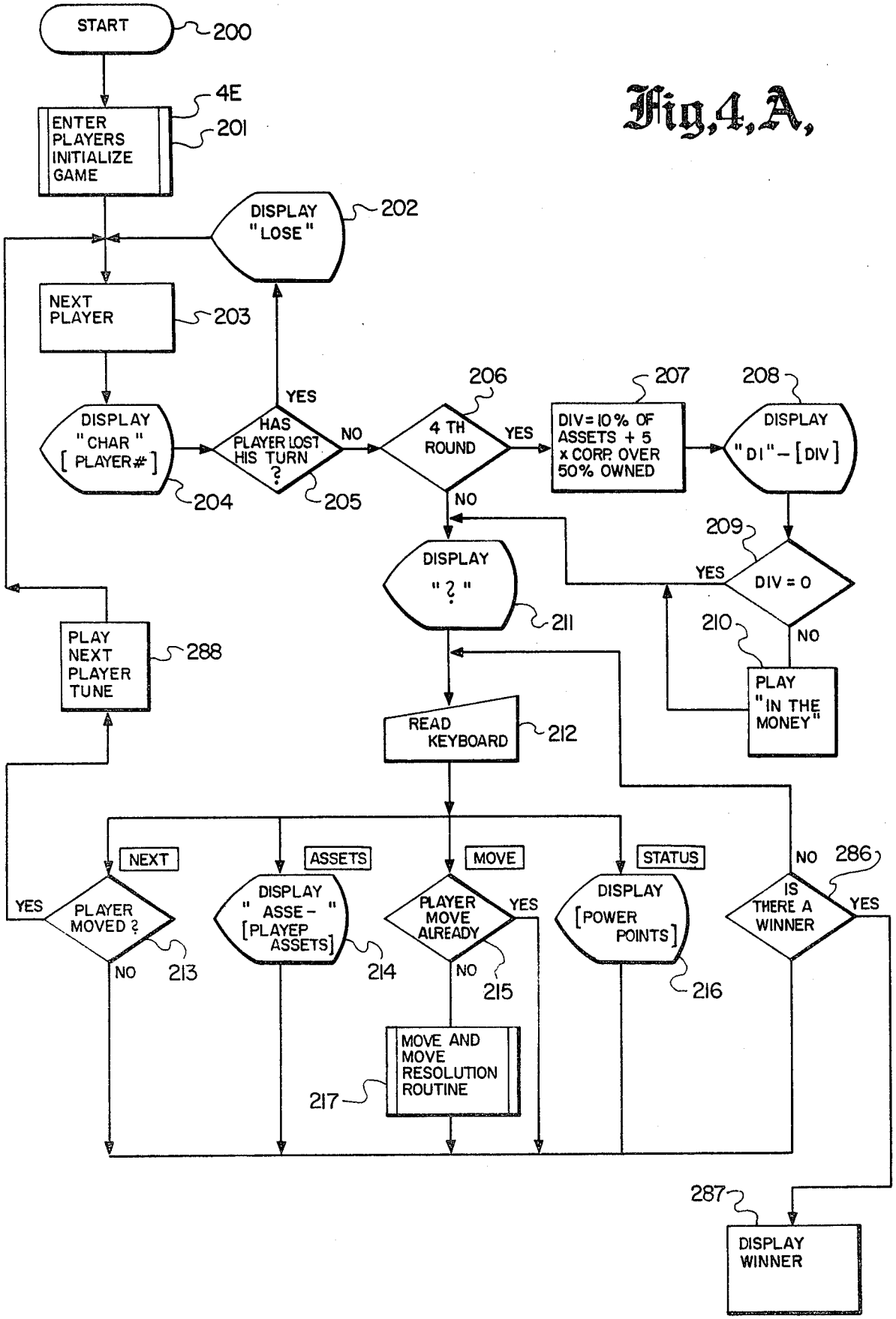

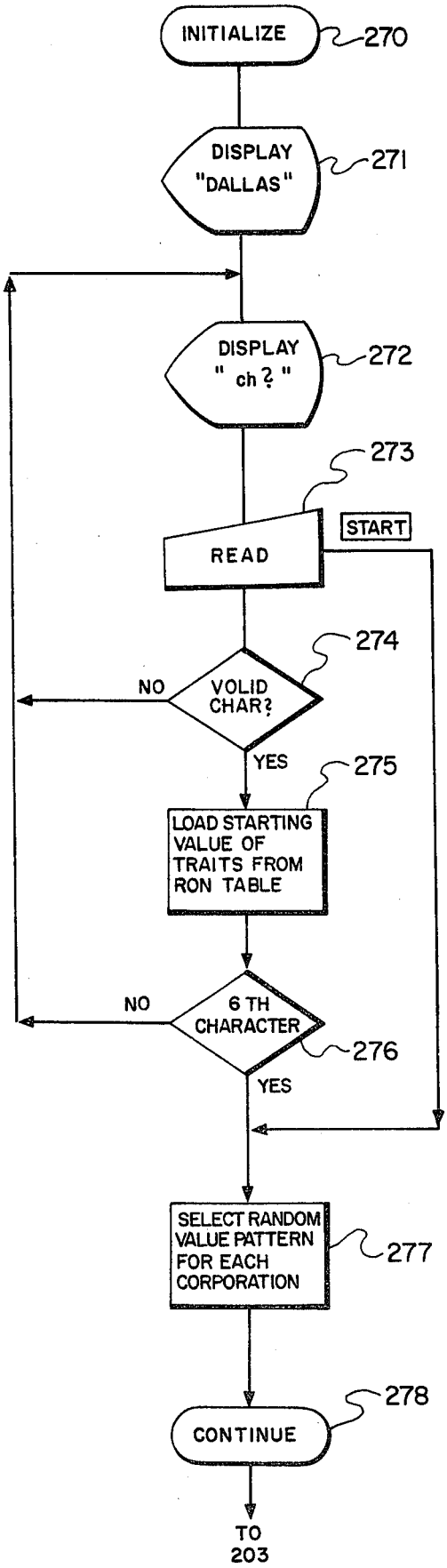
Fig.4E,

ELECTRONIC BOARD GAME

BACKGROUND OF THE INVENTION

This invention relates generally to board games and particularly to those which include an electronic computer.

For many years, games have been available in which a number of players each having a player token have participated in board games in which a playing surface is ruled or segmented into a number of paths or squares and in which a plurality of pre-defined situations are visually indicated upon various board squares. In most instances, a set of game playing situation cards of various types are used with the game board and tokens to provide situation alterations and random chance inputs during the course of game play. For example, in many board games known in the art, the players move a number of squares along a path or in a chosen direction in response to a randomly generated number. Typically, a pair of dice or a "wheel of fortune" type apparatus is used to provide a random number. Generally, each square designates one of several actions to be then taken by the player when landed upon. With the advent of microprocessor electronics and the ready availability of low-cost microcomputer units, the board games were enhanced by being combined with microcomputers. Typically, the board includes a number of visually defined squares and includes the further complications and heightened game interest of microcomputer generated situations. Examples of such recently developed games are the "Dungeons and Dragons Computer Labyrinth Game" presently manufactured by Mattel, Inc. As added enhancement to game play, such computer-cooperating board games are further enhanced by programming the microprocessor therein in such manner that the computer takes an active part in the game process. This process is know in the art as role-playing. In the forementioned Dungeons and Dragons Computer Labyrinth Game, for example, the computer assumes the role of the dragon; that is, the "monster" which is to be avoided by the participants in the game. Also, in Dungeons and Dragons, the maze-like board or playing surface for the game is configured at the beginning of each game in a random fashion by the computer, thereby providing a different maze for each game played.

While such games combining the former technology of board games and the newly emerging microprocessor arts have greatly enhanced the game playing flexibility and interest value of board games, there remains in the art the need and desire for games having increased levels of flexibility, chance, and randomness.

OBJECTS OF THE INVENTION

Accordingly, it is a general object of the present invention to provide an improved electronic board game. It is a more particular object of the present invention to provide an improved electronic board game in which an increased level of complexity and chance is introduced by the computer's cooperation with the board.

SUMMARY OF THE INVENTION

An electronic board game includes a game board having a playing surface upon which a matrix of game squares are defined includes an electronic control unit. The game significance of the squares within the matrix exhibit one of three characteristics. A first plurality of game squares are visually defined while a second plurality are partially of fixed definition and partially defined by a random process for each game. A third plurality of squares are not visually defined but rather are defined in a random process each player turn. The electronic control unit establishes the random definitions of the second and third plurality of squares.

BRIEF DESCRIPTION OF THE FIGURES

The features of the present invention which are believed to be novel are set forth with particularity in the appended claims. The invention together with further objects and advantages thereof may best be understood by reference to the following description taken conjunction with the accompanying drawings in the several figures of which like reference numerals identify like elements and in which:

FIG. 3A through 3C are sample game cards.

FIG. 4A through 4F is a flow chart of the controller of the present invention game.

DESCRIPTION OF THE PREFERRED EMBODIMENT

Figure 1:
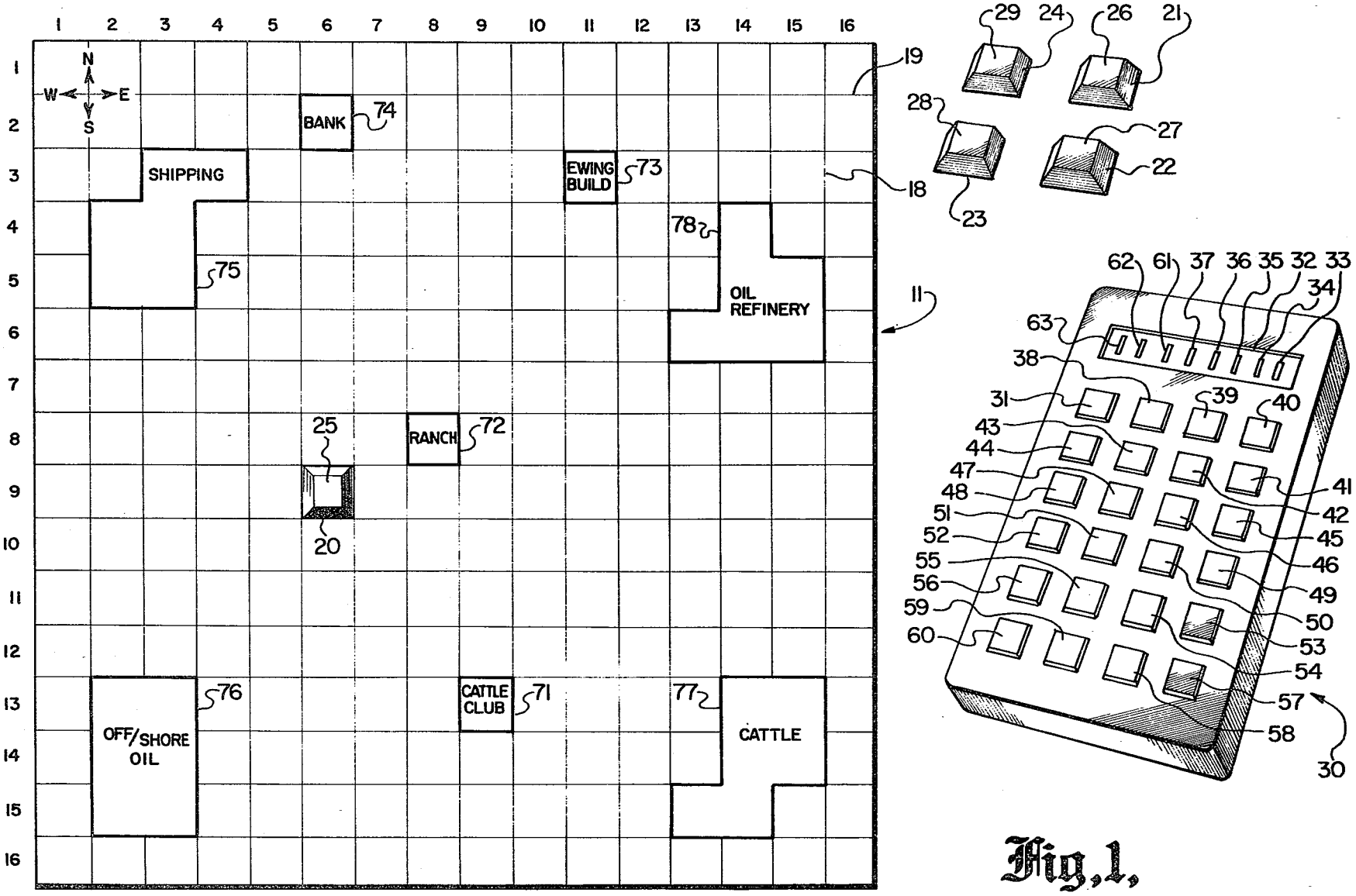
FIG. 1 is a pictorial drawing of the preferred embodiment of the present invention game.

FIG. 1 is a pictorial view of an electronic board game constructed in accordance with present invention . A playing board 10 has a surface 11 which is suitably printed with a pictorial material including a plurality of parallel equally spaced, horizontal lines 19 and a plurality of equally spaced vertical lines 18 which intersect to form a grid-like pattern of squares in a sixteen by sixteen matrix of playing squares. The squares are numbered 1 through 16 in both horizontal and vertical directions from the uppermost left-hand square. Consequently, the position of any square on surface 11 is defined by a vertical and horizontal coordinate intersection. For example, the uppermost left-most square on playing surface 11 is designated 1,1. Similarly, square 12 is designated by the vertical coordinate 2 and the horizontal coordinate 6 or simply 2-6. Similarly, square 15 is designated as 6-5 and so on. By this means, each square on the board is uniquely definable as a combination of a vertical and horizontal coordinate, and as will be discussed more clearly below, each square on the board may be then communicated to the controller unit. Playing surface 11, in addition to vertical and horizontal lines 18 and 19 defines a plurality of visually defined square groups 75, 76, 77 and 78. Such groups are assigned specific game significances and each comprise a combination of six-like colored squares. In addition, board surface 11 defines a plurality of "base" squares 71, 72, 73 and 74. The remainder of squares upon board surface 11 are visually undefined with the exception of their boundaries. To enhance game eye appeal and atmosphere, however, a graphic or pictorial visual enhancement may be blended with the grid definition and visually defined zones on playing surface 11 which actually has no significance in game play. A hand-held controller unit 30 includes a readout portion 32 in which having a plurality of alphanumeric character displays, 33 through 37 inclusive. Controller 30 also includes an on-off switch 31 and a plurality of operator usuable keys 38 through 60, inclusive. The latter provide player input to the controller 30 by means discussed below in greater detail. While controller 30 may comprise any number of mechanical or electric configurations and may, for example, be either a single tabletop unit form which players move in and out of communication or as in the present embodiment a hand-held microprocessor computer unit suitable for passing in a manner described below from player to player as participants take turns. Accordingly, controller 30 will be understood to include certain operative elements common to hand-held microprocessor devices such as a battery on audio tone transducer and appropriate electrical interconnecting wiring. In addition to game board 10 and controller 30, a plurality of player tokens 21 through 24, each having a character assignment number on top surfaces 26 through 29, respectively, are included in the present invention game system. It will be apparent to those skilled in the art that the number of tokens is, of course, adjusted to the number of participants in the game.By way of example, token 20 having an indicator bearing surface 25 is shown positioned on board surface 11 on the square defined as 9-6 in a fashion typical of the token placement during game play situations.

While the complete play of the embodiment of the present invention game shown in FIG. 1 is multifaceted and rather complex and will be described below in greater detail, an important aspect of the present invention may be readily understood by reference to FIG. 1 and to a rather simplified discussion of the basics of game play. It will be apparent, however, to those skilled in the art that other game variations, in addition to, or somewhat different from, the preferred embodiment which follows below can be utilized to employ the present invention game system without departing from the spirit and scope of the present invention.

The initial preparation step for the present invention game requires enrolling the number of each participating player in controller 30. Once on-off switch 31 is turned to the activate position, start key 53 is pressed and thereafter each player in turn presses a selected number key from keys 46 through 48, 50 through 52, 54 through 56, all of which correspond to the number digits 1 through 9 and 59 (which bears the designation 0). During enrollment and after selecting a character number, each player presses enter key 57. After each player has so entered a number into controller 30, start key 53 is again pressed; thereafter the participants take turns operating the control unit 30 and moving their assigned tokens 20 through 24 in accordance with game play rules. After each player completes a turn, controller 30 displays the number of the next participant in order (lowest number first). For example, a player entering character number 1 would be the first participant and controller 30 would indicate the turn of player 1. In response, start key 53 is pressed and the player's current status of game control parameters (described below in greater detail) are displayed or the next move on the board is provided. To institute a move on the board, player 1 presses move key 58 and controller 30 by means described below in greater detail generates a random number. Thereafter, the random number together with the present coordinates of the player's token are displayed on character displays 33 through 37. For example, with token 20 positioned on board 11 as shown in FIG. 1 and if the random number generated is 5, display digits 33 through 37 read 5, 9-7, indicating a move of five squares is allowed in any direction and that the starting position for the move, i.e. the present position of token 20, is at the intersection of squares of row 9 and column 7. Continuing the present example, with a move of 5 squares permitted, player 1 then presses a selected 1 of keys 41 through 44 on control unit 30 up to five times the number of squares which are to be moved. Controller 30 includes four direction keys. Key 41 implements a move to the right on surface 11, key 42 a move downward, key 42 a move upward, and key 44 a move to the left. In other words, to institute a move five squares to the right on board surface 11, player 1 presses key 41 five individual times. Thereafter, on the next turn for player 1 the position digits read 9-12 indicating the last change in position. After completing the number of moves, player 1 then presses enter key 57 and passes control unit 30 to the next player called out on display 32. This process continues from player to player and the tokens for each player are moved across surface 11 in accordance with game rules and game play.

As will be apparent, a great number of game variations and complexities made possible in the present invention system. In accordance with the preferred embodiment game set forth below, several game consequences are assigned to the squares or combinations of squares on surface 11. In addition, in accordance with gaming techniques, additional game complexity is added by the use of direction and consequence type cards of several types. These cards are called out by the square designations and control unit commands given during the course of the game. While the games played may be varied using different themes and character combinations, an important aspect of the present invention game system is found by further discussion of the interrelationship of controller 30 and the square designation for playing surface 11. Therefore, discussing FIG. 1 further and setting aside for the moment descriptions of game cards and other additional material which are combined with the apparatus shown in FIG. 1 for the preferred embodiment described below, an important aspect of the present invention will now be discussed. The foregoing introductory material which gives a basic description of game play in its simplest form, set forth the process by which a succession of players each taking turns using the controller 30 manipulate their particular one of tokens 20 through 24 across the surface of board across surface 11. In accordance with the present invention, surface 11 defines a sixteen by sixteen matrix of individual squares which as mentioned are uniquely identifiable by their vertical and horizontal coordinates. In addition, the squares on board surface 11 are further classified as belonging to one of three categories of game significance.

The first category is that of visually defined fixed significance. That is, the squares or groups of squares are visually indicated as different from other squares on the board and maintain that significance from game to game and from turn to turn for all games. Examples of this first category of games squares are squares 71 through 74 shown on surface 11 in FIG. 1. The second category of squares in the present invention game system is that exemplified by square groups 75, 76, 77 and 78 in FIG. 1 in which squares are grouped in a common manner and visually indicated as belonging to that group. These second category squares defined in part by the visual indication. However, unlike the first category of squares, a portion of the definitions of individual squares within each group is altered from game to game in a random fashion by controller 30. For example, the group of squares 75 actually comprises a group of six squares, that is squares 3-3, 3-4, 4-2, 4-3, 5-2 and 5-3 arranged together and visually indicated as belonging to the same group. The indicator for such groups is a matter of design choice. In the present invention preferred embodiment they are colored the same color. While a portion of the game significance of the squares in each group 75 through 78 are defined, a second parameter of the square significance is not shown by any visual indication and is randomized from game to game by controller 30. For example, square group 75 corresponds to a shipping corporation in the preferred embodiment game scenario in which the ownership of portions of a corporation so defined can be acquired under game rules only by a player manipulating a token to the square forming a part of the total corporation. The total percentage ownership acquired in the corporation defined by given square within group 75 will vary from game to game. For further example, in one game, each of the six squares within group 75 might be of equal value each forming sixteen percent of the corporation ownership. In another game, however, the randomization mentioned of controller 30 might resolve a different corporate significance for each square. For example, square 3-3 might each comprise thirty percent ownership, squares 3-4 and 4-2 twenty percent ownership and squares 4-3, 5-2 and 5-3 ten percent ownership. While the possibilities are numerous, it is important to bear in mind that the squares in the second category are partially defined visually in their game significance and partially defined in a random fashion from game to game by controller 30. Finally, the third group of game square significances, are those squares which remain without any visual indication of game significance. In other words, they are not visually defined. Such squares such as squares 7-1 and 11-16 are the most plentiful in FIG. 1, such non-visually defined third category squares are in essence the remainder of game squares not otherwise visually defined. This third category of squares is entirely under the direction and control of controller 30 which randomizes the significance of such third category squares for each individual player turn. Each player, therefore, it challenged on each turn by a partially unseen board arrangement not seen on previous turns. This, of course, greatly enhances the flexibility play value and challenge of the present invention game.

While it will be apparent to those skilled in the art that numerous games can be created using the present invention three-tiered square definition system, it should be emphasized that the preferred embodiment game is set forth here by way of example and not limitation. Variations of game theme and scenario are will within the skills of practitioners in the art.

As mentioned, the present invention game in its preferred embodiment includes additional game and event cards. FIG. 3A shows a sample corporate ownership certificate 80 while FIG. 3B shows a sample blackmail card 81 which bears a scenario or theme element which can be used by the holding player to strengthen player position in arising conflicts (set forth below in greater detail). FIG. 3C shows a sample confrontation card 82 which determines the nature of event or conflict ordered by the controller 30 when a player lands on blank square and such a conflict is ordered by the controller's "character". Also included are appropriate units of "play" money (not shown) for use in currency exchange between players, etc.

The initial game set-up procedure for the present invention game is carried forth by first having each player draw or choose a player token which as mentioned bear character numbers. The selected tokens are stacked in numerical order (lowest number on top) on square 72 of board which is the "starting point" square. Next, a banker is chosen from the players who distributes and collects game money for purchase of corporate share parcels aand deposits in bank, collects money owed to bank or the controller, and does other general banking functions. Thereafter, a broker is also chosen from the players to distribute Ownership Certificates when corporate share parcels are purchased and placed upon corporate squares the correct ownership markers when needed. Finally, the blackmail cards are shuffled and stacked, and same money is evenly distributed among players.

While the present invention game is complex and multifaceted, the basic steps of player participation are as follows:

Each player in turn presses the key on the controller unit corresponding to the player's character number and the enter key. Next, the stark key is pressed once all players have entered their character numbers. Afterwhich, the players taken turns in order of character numbers, lowest number first in the following manner. To begin each turn, the player presses the start key. The player can then either check the current assets, etc., by pressing the status key causing the points of Prestige-Business-Family to be displayed in order. To check assets (value of all corporate shares owned) the assets key is pressed. Next, the move key is pressed causing the controller to generate a random "dice roll" number. After the move key is pressed, the controller display shows "dice roll" followed by starting position coordinates, of the player's token in a vertical then horizontal coordinate fashion as set forth above. Within the rules of the presently discussed embodiment, a player can move any number of squares up to the dice roll number, in one direction only. This, of course, represents a game rule choice rather than a limitation on the present invention. The player then moves the character token to the appropriate square on the board and enters the move on the controller by pressing direction keys (North, South, East or West). Once for each square moved. At the end of move, the enter key is pressed and any transactions called for or allowed by the square on which the player landed are completed. As will be discussed below in greater detail, three basic possibilities exist for each move. Briefly, they are "base" squares 71, 72 or 73 at which the player collects money or a blackmail card, "corporate" squares such as groups 75, 76, 77 or 78 permitting a player to buy a corporate share parcel or engage in player conflict, and the remaining "unmarked" squares. In the final situation, an important aspect of the present invention is operative to produce randomized possibilities. At the end of turn, the next key is pressed and the controller is handed to next player. The first player to amass assets enough to take over the Empire wins. The controller announces winner with a victory tune and displays character number of winner.

As mentioned above, each time a player takes a turn, the player's token will have been moved and the effects of that move will be determined largely by the type of square landed upon. The three possible types of squares upon which a player token may land, that is base, corporate or blank squares.

A player token landing upon a base square is "safe" that is the player's corporate shares are safe from attack. In addition, the player may collect either money or a Blackmail Card for landing on a base square. While it is strictly a matter of game design, in the present embodiment game, a player landing upon ranch square 72, club square 71 or company headquarters square 73, takes a Blackmail Card. A player landing upon bank squares 74 be paid 20% of the player's total assets. After having landed on a base, the player's turn is over.

A player token landing upon a blank surface results in either two possibilities which depend upon whether or not the square is occupied by another player's token. A player landing upon an occupied blank square may attack the player on that square. In which event the controller display shows conflict? If an attack is chosen, the type of conflict is selected by pressing an appropriate key on the controller. If more than one player occupies that square, the controller will then display "Player?" requesting the character number of player to be attacked. If no attack is asserted, the player presses the NO key on the controller and the turn is ended. If the blank square upon which a player lands is unoccupied, three possibilities are raised. First, a jump may result in which event the controller directs the player to move the token to an indicated set of coordinates which are randomly generated by the controller. If sent to another blank square, the player's turn is over. If, on the other hand, the player is sent to an occupied square, a base of a corporate square, the player's turn continues as though the token landed there by player move. The second blank square possibility calls for an event. The controller displays E-(number from 1–8)? This number correponds to an Event/Confrontation Card listing (shown below). This play is optional it may be accepted or rejected. If accepted, the YES key is pressed and the action is completed. Complete your turn. If rejected, the NO key is pressed and a Blackmail Card is taken. Alternatively under the second blank square possibility, a fixed event may occur. In this case, the controller displays E-(number from 9–16). The number is looked up on the Event/Confrontation Card (shown below). This result must be accepted. The event is completed ending the player's turn. The third blank square possibility is a confrontation with the "character" of the controller unit. In this event, the display shows CON-(number from 1–8). This number is looked up on the player's Event/Controller Confrontation table. A situation will be presented which may force lost points. If the player has a Blackmail Card on the controller, the number key for code on Blackmail Card held (a number from 1–3) in entered and the Blackmail Card is discarded. If no Blackmail Card on the controller is being held a "NO" is entered and the controller determines winner of the conflict. If the player wins, a rising tune is played and character points are gained. If the player loses the controntation, a falling tune is played, character points are lost and the token is moved to Company Headquarters square 73.

In accordance with an important aspect of the present invention, the designation of the blank squares as to the first, second or third possibilities set forth above is randomly configured by the controller in a different manner for each player turn. This provides greatly increased game complexity and play appeal not found in prior art games.

The square groups which designate corporations are Shipping 75, Oil Refining 78, Off/Shore 76 and Cattle 77. As mentioned, each corporation comprises six contiguous squares, the relative values of which are randomly determined by the controller each game. Three squares ae valued at 10%, two are valued at 20%, and one is valued at 30%. Until a player lands on a given corporate square, its share value is unknown.

If corporate square is unowned and is landed upon, the landing player may buy it. The display shows the corporate name and value of that share parcel. The share parcel may be purchased by pressing the YES key and pay by the purchase price to banker. An Ownership Certificate is received and owned marker with same letter code as that on Ownership Certificate is placed on the square. To decline purchase may be declined by pressing the NO key. In this event, an option marker with correct value percentage (10%, 20% or 30%) is placed on the square. If an unowned corporate square is landed upon which is occupied by another player, the landing player may either attack occupying player or buy the share parcel. If an owned unoccupied corporate square is landed upon, the landing player may attack the owned share parcel. In either event, the conflict resulting from the attack are resolved by the controller using the rules of conflict described below. If corporate square is owned and occupied, the landing player may attack either the share parcel (unless owner is on a base) or the occupying player. Again the conflict is resolved by the controller.

Conflicts whether between players or between a player and the "character" played by the controller are resolved by a tiered system. At the first level, any unanswered or uncountered blackmail card against any participant decides the issue in favor of the blackmail card holder. If no blackmail cards are used or if each applied blackmail card is met by a blackmail card by the other player (countered), the conflict is resolved by the controller using the system of character points.

The character points used by the controller to help determine the winner in player and controller conflicts are altered during game play. Different character points can be gained or lost, through events or conflicts within the game rules. Each player starts the game with a total of 20 character points, distributed within the categories of prestige, business and family. Points are distributed differently for each character. Point distribution are pre-programmed and always start out the same for a particular character. This variation of points within the three categories provides another important aspect of the present invention game. The players select a character for game play and thereafter must work within the attributes of that character. This provides a role-playing facet to the present invention game. In addition, because the resolution of conflicts and confrontations involving a character during the game play changes the character points in these categories and alters the "character" of the player. By way of example, steady loss of conflicts with other family members can reduce the family points held by that character.

In the preferred embodiment, each player holds a list for the selected character different from other characters. The character lists provide a numerically indexed set of optional events, mandatory events and confrontations with the "character" played by the controller. In this manner, confrontations and conflicts are communicated between the players and the controller by number. For example, for a given character a sample optional event may be numbered "1" and state "you pay $4 million for shrewd oil investment." Gain one business and one prestige point. Similarly a sample mandatory event may be numbered "5" and read "you have neglected your wife—Lose one family point". Finally, a sample confrontation with the controller may be numbered "7" and read "Controller'3 character observed your meeting with a known criminal—Lose one prestige point". As will be apparent, for various game themes, numerous lists of such events and conflicts can be written and used to give substance to the game's characters and need not be set forward in detail herein.

Figure 2:
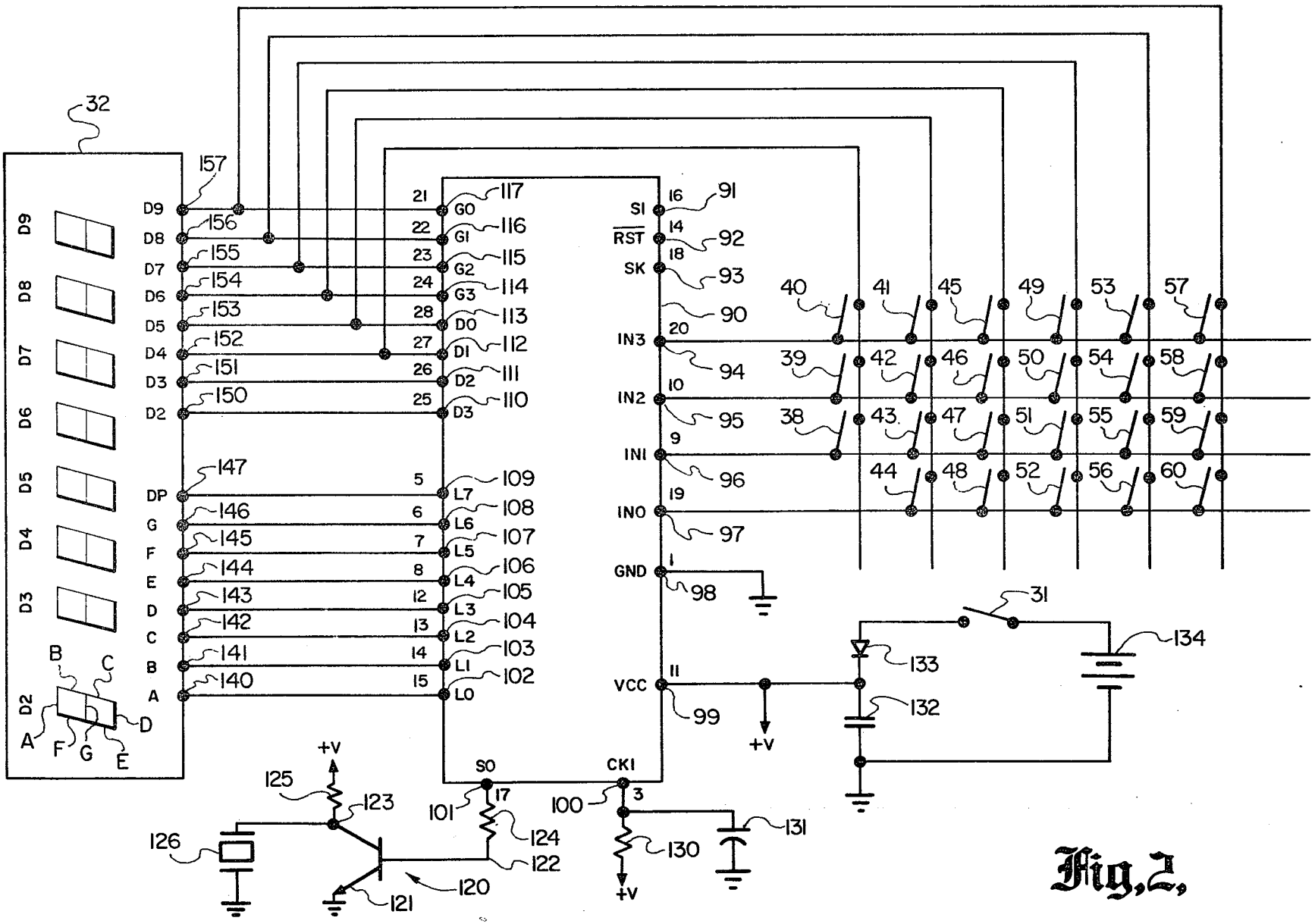
FIG. 2 is a schematic of the present invention controller.

FIG. 2 sets forth a schematic diagram of the preferred embodiment of the present invention game. In the preferred embodiment a microprocessor 90 comprises a National Semiconductor microprocessor chim COP 444L present-16 manufactured and supplied to the public and described fully in National Semiconductor application literature. Microprocessor 90 could, of course, comprise in different embodiments any number of the presently availably microprocessor circuits. Microprocessor 90 includes a plurality of connection terminals 91 to 117 inclusive which facilitate electrical connections to the external circuitry. For purposes of clarity, the commonly used designations of terminal functions such as SI for terminal 91 and SK for terminal 93 and so on, are maintained. Similarly, the numbers immediately adjacent each of the terminals 91 through 117 of microprocessor 90 designate the pin number therefor under the conventional numbering system of the integrated circuit COP 444L chip. A matrix of switches constructed in a conventional state of the art switch matrix forms the keyboard of controller 30 and comprises switches 38 through 60 inclusive. In accordance with well-known fabrication techniques, the matrix of switches 38 through 60 provides selective coupling between terminals 94 through 97 of microprocessor 90 and terminals 112 through 117, respectively, of microprocessor 90 and terminals 152 through 157 of a conventional light emitting diode (LED) display 32. Terminal 98 of microprocessor 90 is connected to ground and Terminal 99 of microprocessor 90 forms the input terminal for operating potential. Terminal 100 of microprocessor 90 is coupled to ground via a capacitor 131 and to a source of operating potential via a resistor 130. Terminal 101 of microprocessor 90 is coupled to a resistor 124. A transistor 120 has an emitter electrode 121 connected to ground, a base electrode 122 connected to resistor 124 and a collector electrode 123 connected to a source of operating potential by a resistor 125. A ceramic electro-acoustic transducer 126 is connected between collector 123 and ground. Terminals 102 to 109 of microprocessor 90 are connected respectively to terminals 140 through 147 of display unit 32. Similarly, terminals 110 through 117 of microprocessor 90 are connected to terminals 150 through 157 respectively, of display unit 32.

Display unit 32 comprises a conventional array of LED elements designated D2 through D9 inclusive. It should be noted that a conventional digit element array is used in accordance with well-known and accepted display techniques. Accordingly, digit D2 is shown to have its elements or segments alphabetically coded A through G inclusive. As will be understood by those skilled in the art that digits D3 through D9 are similarly coded. Again, in accordance with well-known display techniques, each element of each digit is controlled by a pair of matrix inputs. The first matrix input, terminals 140 to 147 of display 32 are commonly connected to the corresponding alphabetically designated segment of each digit, D2 through D9. Similarly, the second matrix input is a common digit energizing electrode for each individual digit. The common digit electrode of each of digits D2 through D9 is coupled to terminal 150 to 157 of display 32, respectively. By way of explanation, it will be apparent to those skilled in the art that the selective activation of each alpha designated segment of any digit is achieved by simultaneously energizing the alpha segment on segments of a selected digit and the digital electrode for that digit.

Microprocessor 90 which as mentioned comprises a National Semiconductor COP 444L microprocessor chip includes an internal memory system and logic processing circuitry to enable it to carry forth the computing functions in accordance with the pre-programmed game rules in the present embodiment game.

The accompanying flow charts and functional explanations of the preferred embodiment set forth herein shall be understood to be in some sense particularized to the National Semiconductor COP 444L processor unit. It will be apparent to those skilled in the art that the use of a different microprocessor chip can be employed along with suitable changes in programming and electrical configurations to fulfill the requirements and performance needs of the present invention game without departing from the spirit and scope of the present invention. While it is believed that the circuit diagram of FIG. 2 together with the flow chart of FIG. 4 and the discussions which accompany them amply describe the present invention, reference may be had to the appended program code listing for additional information if required.

FIGS. 4A through 4F set forth in detail the flow chart of the present invention controller 30. The program is entered at start step 200 and from there proceeds to a process routine 201 which is set forth in detail in FIG. 4E. From step 201 after players have been entered and the game initialized in step 201, a program proceeds to step 203 and from there to 204 in which a display requiring setting forth the character is entered. Thereafter, the program proceeds to step 205 in which an inquiry is made as to whether a player has lost his turn. If yes, the program returns to step 202 in which the lost turn is displayed thereafter returning the program to 203 in which the player is incremented one number. If no lost turn is involved. The program proceeds to a decision step 206 in which the determination is made as to whether the fourth round has been entered. If Yes, the program proceeds to step 207 for calculations of assets and corporation values. From step 207, the program proceeds to a step 208 in which the division of assets is displayed. If the response is negative at step 206, the program proceeds to a step 211 in which a question mark is displayed. Thereafter, the program proceeds to a step 212 in which the keyboard is read. Depending upon which key is pressed and read in step 12, the program will proceed to step 212 via step 214 in which assets are displayed or 216 in which power points are displayed. Alternatively, the program will proceed depending upon the key read in step 212 to a decision step 215 in which the inquiry is made as to whether a player has moved. IF yes, the program returns to step 212. If no, the program moves to a subroutine 217 which determines the move made and resolves the move in accordance with the detailed subroutine flow chart in FIG. 4B. Finally, the fourth alternative from the keyboard read in step 212 inquires as to whether a player has been moved. If no, the program proceeds back to step 212. IF yes, the program proceeds to step 288 in which the next player tune is played and from there back to step 203.

Figure 4B:
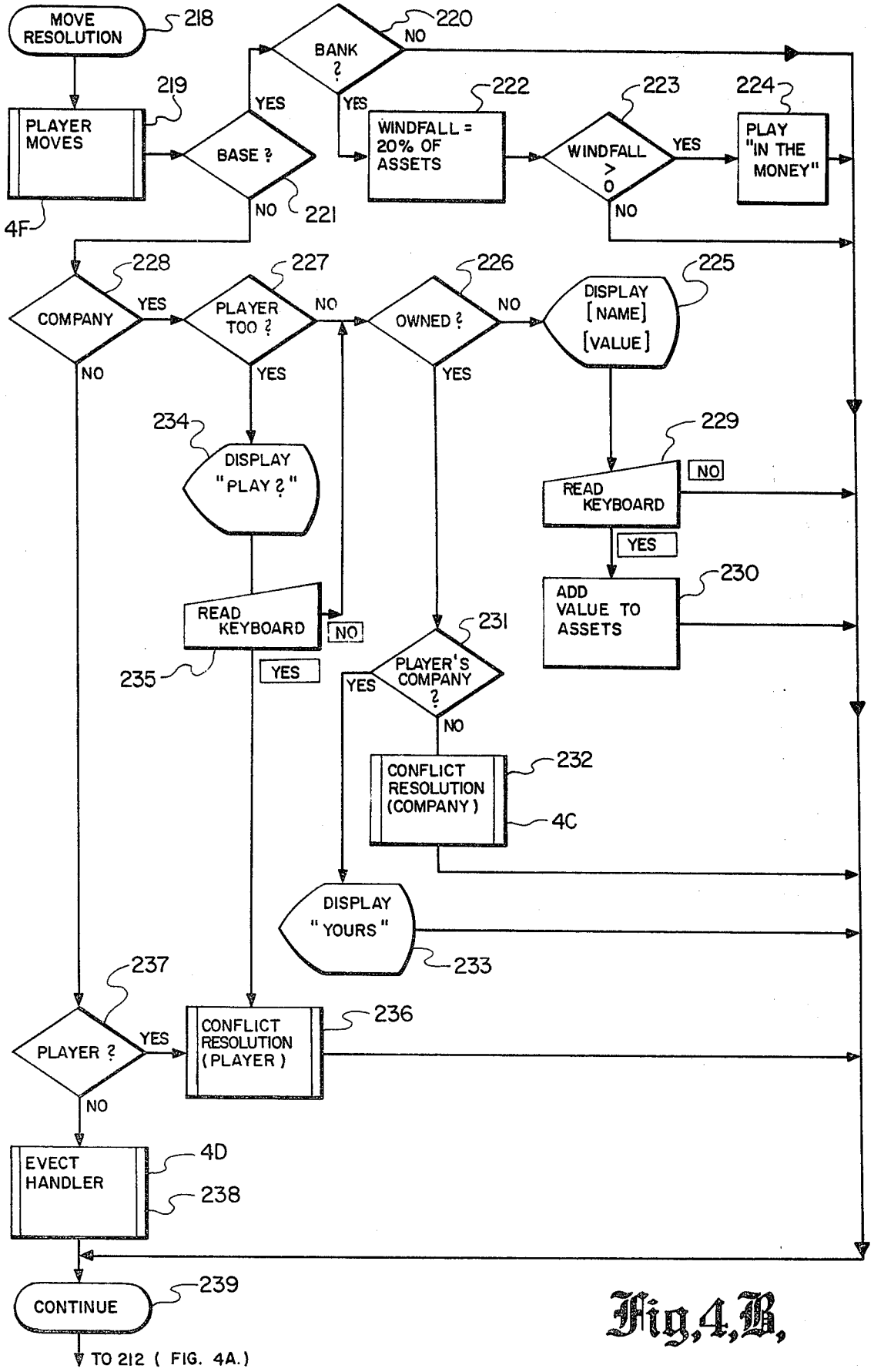

The flow chart set forth in FIG. 4A comprises the basic operating flow chart for the present invention electronic board game controller. The following discussions of FIGS. 4B through 4F describe the various subroutines within the program of a present invention. The subroutine 217 in FIG. 4A is set forth in FIG. 4B in detail beginning with a move resolution step 218 which moves to a player move subroutine 219 which is set forth in detail in FIG. 4F. After player movement the program moves to a inquiry in step 221 in which a determination is made as to whether a base square is occupied. If yes, the program moves to step 220 at which inquiry is made as to whether the square is the bank. If no, the program exits to step 239 and from there returns to step 212 in FIG. 4A. If yes at 220, the program moves to step 222 in which a determination of windfall equal to 20% of current assets is made and from there to a decision step in which an examination is made of the result in step 222 and if greater than zero the program moves to step 224 in which a tune announcing the acquistion of money is played. Thereafter, the program moves to step 212 in FIG. 4A via continue step 239. Returning to step 221, if a negative response is received, the program moves to an inquiry 228 in which a determination is made whether a company square has been landed upon. If no, the program moves to step 237 in which a decision is made as to whether a player conflict is involved. If no, the program moves to a subroutine 238 shown in FIG. 4D in detail in which the various details of event resolution are carried forth. Thereafter, the program returns to step 212 in FIG. 4A via step 239. Returning to step 237 if yes, the program moves to a subroutine 236 shown in FIG. 4C in which the player conflict is resolved. Thereafter, the program again returns via step 239 to step 212 in FIG. 4A. Returning to step 228, if an affirmative response to company is made, the program moves to an inquiry step 227 in which a determination is made as to whether a player occupies the square also. If no, the program moves to step 226. If yes, the program moves to display step 234 and from there to a keyboard read step 235 and from there to a conflict resolution step 236. From step 226 a decision is made as to whether the square is owned. If no, the program moves to a display step 225 which sets forth the name and value and from there to a keyboard read step 229 from which the program returns via step 230 to step 212 in FIG. 4A. If in step 226 it is determined that the square is owned, the program moves to a step 231 in which a determination is made as to whether the company belongs to the player. If yes, the program moves to step 233 in which the ownership of the player is displayed and the program thereafter returns to step 212. If no, the conflict resolution step 232 shown in FIG. 4C in detail is entered.

Figure 4C:
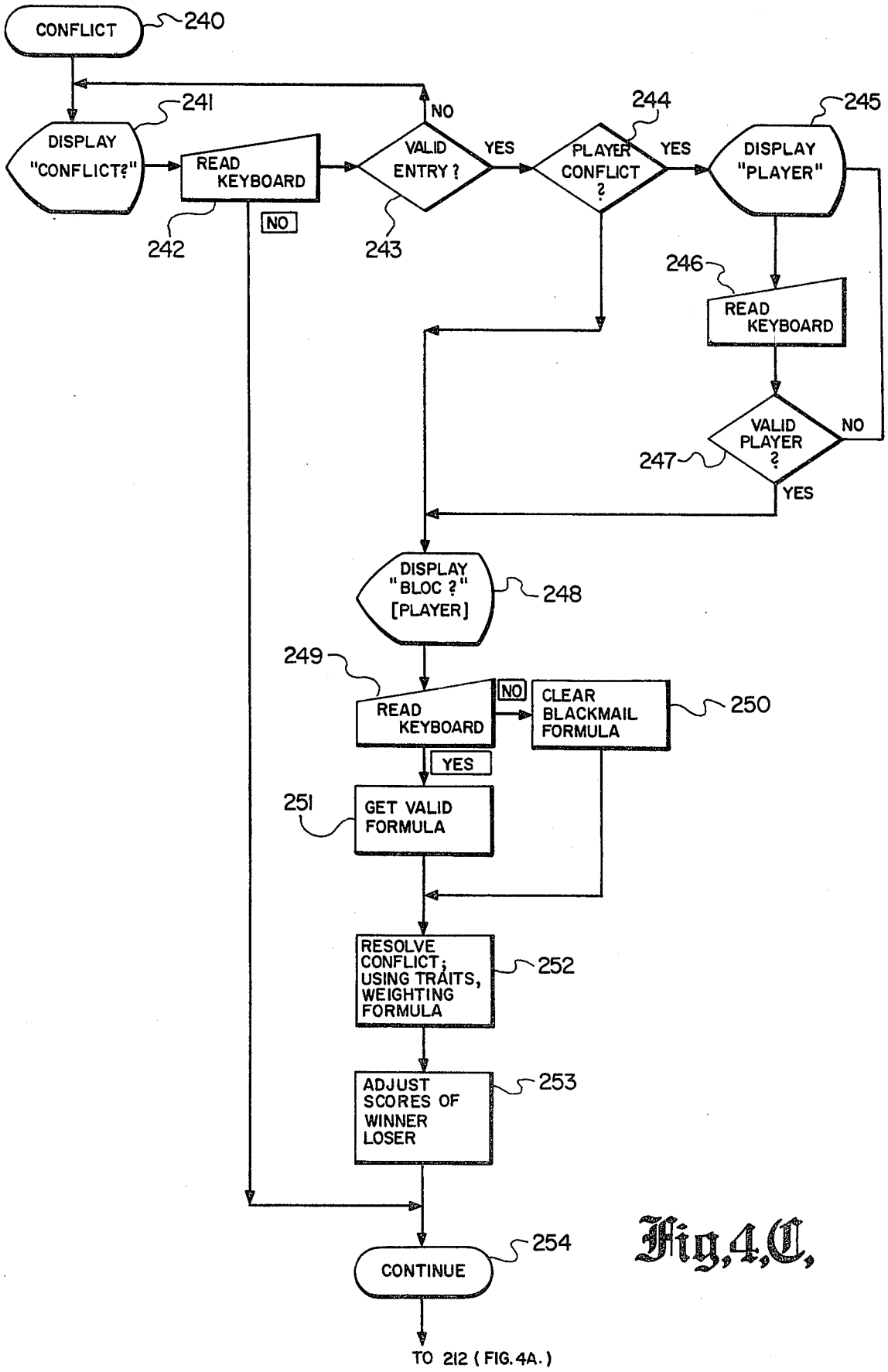
Figure 4D:
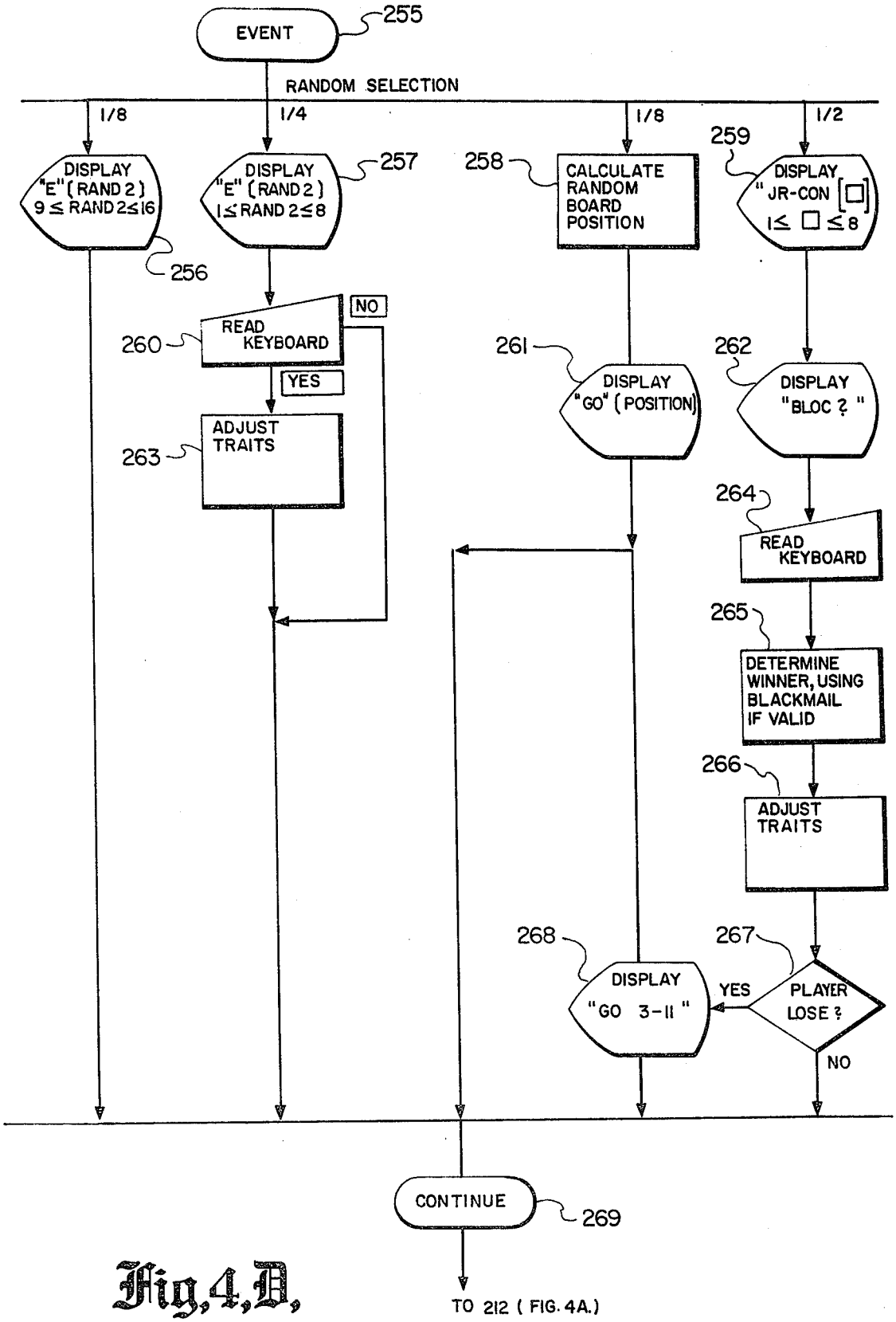
Figure 4F:
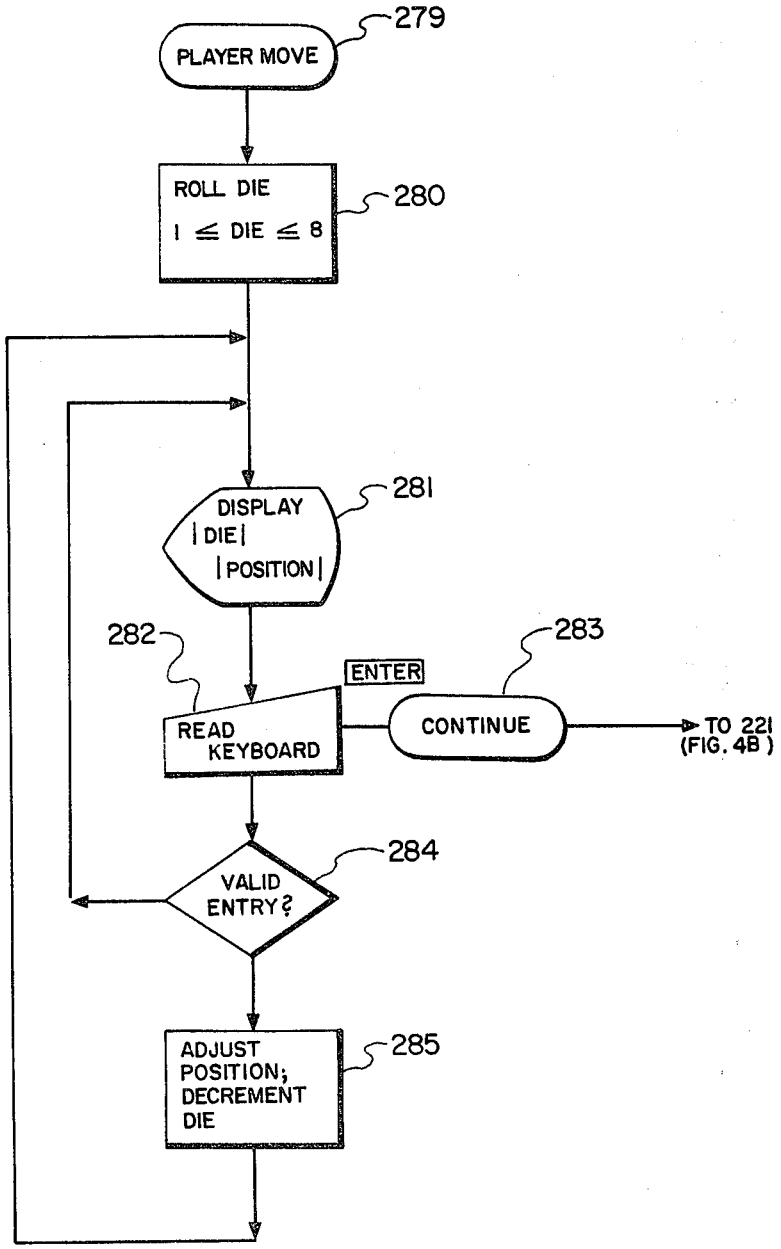

As can be seen, the flow chart in FIGS. 4A and 4B set forth the entire routine of the present invention game. FIGS. 4C through 4F set forth in detail the subroutines found in FIGS. 4A and 4B. FIG. 4C sets forth in detail the conflict resolution subroutine which is entered in steps 232 or 236 of FIG. 4B. Similarly, FIG. 4D sets forth in detail the steps found in event handling step 238 in FIG. 4B. FIG. 4E sets forth in detail the entry of players and game initialization step 201 shown in FIG. 4A. Finally, FIG. 4F sets forth the details of the player move subroutine 210 in FIG. 4B.

It is believed clear to those practitioners in the art that given the flow charts 4A through 4F and the discussions and explanations foregoing, any number of suitable computer programming routines could be constructed which would carry forth the present invention game. Further, it is believed clear that practitioners in the art if using a different microproccessor rather than than the national semi-conductor COP444L set forth herein could with the foregoing explanations, flow charts, and operational descriptions construct similar games which would utilize and practice the present invention. It is also recognized that such similar structures whether using the national semi-conductor COP444L microprocessor or not could carry forth the present invention system with slight variations of the flow charts found in FIGS. 4A through 4F and would result in somewhat different program routines. It is understood that numerous computer program listings could be compiled which would carry forth the present invention. It is further believed that the foregoing explanations, flow charts, and descriptions amply describe the present invention system to those practitioners in the art. However, there is included for deposit in the patent office file for the present invention a code listing used in the present invention preferred embodiment game for reference and informational purposes.

There is further included for informational purposes and deposited in the patent office file, a copy of game instructions for a copyrighted game called "Dallas" manufactured by Mattel, Inc., Hawthorne, Calif.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. An electronic board game in which a group of players compete under game rules by taking turns, said electronic board game comprising:

a plurality of player tokens;

a playing surface defining a matrix of squares; including a first plurality of squares having means indicating upon the squares thereof membership of said squares in said first plurality of squares and a second, and a third plurality of squares, each of said squares in said first, second and third pluralities of squares being capable of being occupied by a single player token;

control means assigning a first game significance to said first plurality of squares which is not altered from game to game and a second game significance to said second plurality of squares which is randomly varied from game to game and a third game significance to said third plurality of squares which is randomly varied for each player turn, said first, second and third game significances of each plurality, each including player individual responses and consequences unique to that plurality.

2. An electronic board game as set forth in claim 1 wherein said first plurality of squares is visually distinct on said board from said second and third pluralities and wherein said control means includes means declaring a player confrontation in the event two player tokens simultaneously occupy a square and means for resolving said conflict in accordance with game rules.

3. An electronic board game as set forth in claim 2 wherein said second plurality of squares are visually distinct from said first and third pluralities of squares and wherein said squares of said second plurality are grouped into a plurality of groups each group being further distinct from other groups.

4. An electronic board game as set forth in claim 3 wherein said visual distinctions comprise color differences and wherein said control means includes microprocessor computing means having therein memory means causing said computing means to impose a predetermined set of game rules upon said players.

5. An electronic board game as set forth in claim 4 wherein said first game significance is an instruction to perform a predetermined task.

6. An electronic board game as set forth in claim 5 wherein said second game signficance includes a fixed element not varied from game to game nor turn to turn and a variable element randomly changed from game to game.

7. An electronic board game as set forth in claim 6 wherein said fixed element includes property ownership and said variable element includes different percentages of said property ownership for said squares in said groups.

* * * * *